US011362417B1

(12) United States Patent
Ding et al.

(10) Patent No.: US 11,362,417 B1
(45) Date of Patent: Jun. 14, 2022

(54) END COVER AND RADOME ASSEMBLY WITH THE END COVER

(71) Applicants: ROSENBERGER TECHNOLOGIES CO., LTD., Suzhou (CN); ROSENBERGER TECHNOLOGIES LLC, Budd Lake, NJ (US)

(72) Inventors: Dongfeng Ding, Suzhou (CN); Junhao Shi, Suzhou (CN)

(73) Assignees: ROSENBERGER TECHNOLOGIES CO., LTD., Suzhou (CN); ROSENBERGER TECHNOLOGIES LLC, Budd Lake, NJ (US)

( * ) Notice: Subject to any disclaimer, the term of this patent is extended or adjusted under 35 U.S.C. 154(b) by 0 days.

(21) Appl. No.: 17/386,931

(22) Filed: Jul. 28, 2021

(51) Int. Cl.

| | |
|---|---|
| ***H01Q 1/42*** | (2006.01) |
| ***H01Q 1/24*** | (2006.01) |
| ***H01Q 1/00*** | (2006.01) |
| ***H01Q 1/36*** | (2006.01) |

(52) U.S. Cl.
CPC ..... *H01Q 1/42* (2013.01); *H01Q 1/005* (2013.01); *H01Q 1/246* (2013.01); *H01Q 1/36* (2013.01)

(58) Field of Classification Search
CPC ..... H01Q 1/005; H01Q 1/42; H01Q 1/27; H01Q 1/28; H01Q 1/282; H01Q 1/32; H01Q 1/3275; H01Q 1/246
See application file for complete search history.

(56) References Cited

U.S. PATENT DOCUMENTS 2,419,480 A * 4/1947 Bryan ..... H01Q 7/04 343/705
10,454,162 B2 * 10/2019 Proshold ..... H01Q 1/42
2003/0067182 A1 * 4/2003 Rochford ..... H01Q 1/42 296/180
2009/0223164 A1 * 9/2009 Cook ..... H01Q 1/005 52/651.07
2009/0325443 A1 * 12/2009 Blackden ..... D06C 5/005 139/35

(Continued)

FOREIGN PATENT DOCUMENTS

CN 208272135 U 12/2018
KR 20060106988 A * 10/2006 ..... H01Q 1/22
KR 20060106988 A * 10/2006

OTHER PUBLICATIONS

KR 2006-106988 English Abstract (Year: 2006).*

*Primary Examiner* — Dameon E Levi
*Assistant Examiner* — Jennifer F Hu
(74) *Attorney, Agent, or Firm* — Anova Law Group, PLLC

(57) ABSTRACT

An end cover includes an end cover plane perpendicular to a longitudinal axis of a radome and passes through a connection part of the end cover and the radome. Outlines of a cross section of the end cover includes a first spline curve between a first end point and a first intermediate point having at least one first curvature, and a second spline curve between a second intermediate point and a third intermediate point having at least one second curvature. The first intermediate point and the second intermediate point are not in the end cover plane. A distance between the first intermediate point and the end cover plane and a distance between the second intermediate point and the end cover plane are equal and not less than a distance between any point on the cross section of the end cover and the end cover plane.

20 Claims, 10 Drawing Sheets

(56) References Cited

U.S. PATENT DOCUMENTS

| | | | | |
|---|---|---|---|---|
| 2017/0313402 | A1* | 11/2017 | Flores | H01Q 1/42 |
| 2021/0091449 | A1* | 3/2021 | Weber | B64C 21/10 |
| 2021/0344098 | A1* | 11/2021 | Huang | H01Q 1/005 |

* cited by examiner

END COVER AND RADOME ASSEMBLY WITH THE END COVER

CROSS-REFERENCE TO RELATED APPLICATION

This application claim priority to Chinese Patent Application No. CN 202110269862.4, filed Feb. 2, 2021, the entire content of which is incorporated herein by reference.

TECHNICAL FIELD

The present disclosure relates to the technical field of antenna and, more particularly, to an end cover for reducing wind resistance of the antenna, and a radome assembly with the end cover.

BACKGROUND

In recent years, with a rapid development of science and technology, wireless mobile communication technology has been rapidly promoted globally. In order to solve a contradiction between supply and demand of wireless mobile data, new spectrum bands, new cellular technologies (such as LTE), and multi-antenna technologies (such as MIMO) have emerged to meet a growing demand for the mobile data. As a result, each mounting tower of a base station antenna needs to be mounted with a larger number of antennas, which inevitably causes antenna size to become larger and larger, thereby increasing wind resistance experienced by the antenna.

Currently a mainstream radome still has a rectangular cross-sectional shape. This cross-sectional shape is a blunt body shape. When the wind flows over the surface of the radome, it generates separation of eddy current and fluid, thereby generating a complex air force that causes the base station antenna to vibrate. In addition, a current mainstream station building model for most base station antennas is a single-tube communication tower with a steel structure, which has disadvantages of low rigidity and large horizontal displacement of tower top. Therefore, reducing the wind resistance of the antenna can not only improve reliability of the antenna, but also reduce mounting and fixing costs of the base station antenna.

SUMMARY

In accordance with the disclosure, there is provided an end cover including an end cover plane that is perpendicular to a longitudinal axis of a radome and passes through a connection part of the end cover and the radome. Outlines of a cross section of the end cover includes a first spline curve and a second spline curve. The first spline curve is between a first end point and a first intermediate point, and has at least one first curvature. The second spline curve is between a second intermediate point and a third intermediate point, and has at least one second curvature. The first intermediate point and the second intermediate point are not located in the end cover plane. A distance between the first intermediate point and the end cover plane and a distance between the second intermediate point and the end cover plane are equal and not less than a distance between any point on the cross section of the end cover and the end cover plane, and an average value of the at least one first curvature is greater than an average value of the at least one second curvature.

Also in accordance with the disclosure, there is provided a radome assembly including a radome and an end cover mounted at an end of the radome. The radome includes a first accommodation cavity configured to accommodate a plurality of radiating elements. The end cover includes an end cover plane that is perpendicular to a longitudinal axis of the radome and passes through a connection part of the end cover and the radome. Outlines of a cross section of the end cover includes a first spline curve and a second spline curve. The first spline curve is between a first end point and a first intermediate point, and has at least one first curvature. The second spline curve is between a second intermediate point and a third intermediate point, and has at least one second curvature. The first intermediate point and the second intermediate point are not located in the end cover plane. A distance between the first intermediate point and the end cover plane and a distance between the second intermediate point and the end cover plane are equal and not less than a distance between any point on the cross section of the end cover and the end cover plane, and an average value of the at least one first curvature is greater than an average value of the at least one second curvature. The first spline curve of the end cover is located on a curved surface, and a projection of a radiation arm of the radiating element on the end cover plane of the end cover is within a projection of the curved surface on the end cover plane.

BRIEF DESCRIPTION OF THE DRAWINGS

The embodiments are shown and described with reference to the drawings. The drawings are used to describe the basic principles, and therefore only show the aspects necessary for understanding the basic principles. The drawings are not to scale. In the drawings, the same reference numerals indicate similar features.

Figure 1:
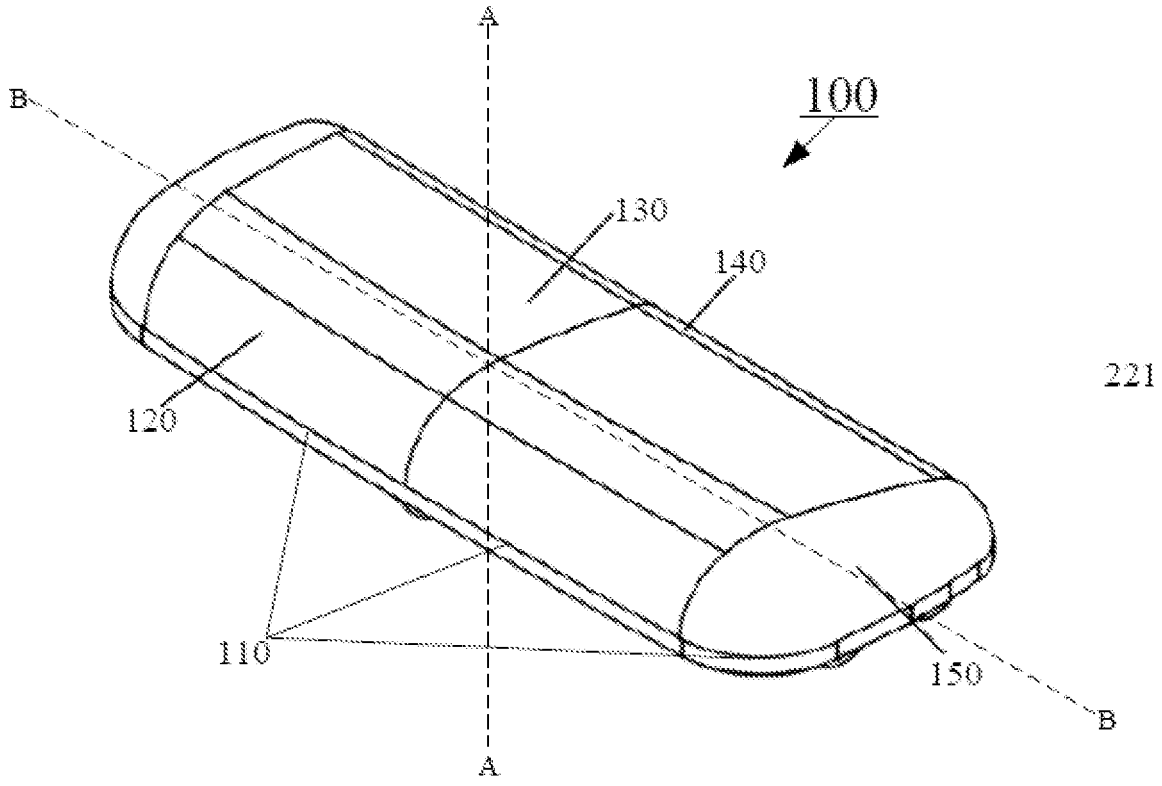
FIG. 1 shows a perspective view of an end cover 100 for a radome according to an embodiment of the present disclosure.

Other features, characteristics, advantages, and benefits of the present disclosure becomes more obvious through the following detailed description in conjunction with the accompanying drawings.

DETAILED DESCRIPTION OF THE EMBODIMENTS

In the following detailed description of some embodiments, reference is made to the accompanying drawings constituting a part of the present disclosure. The accompanying drawings exemplarily illustrate some specific embodiments capable of implementing the present disclosure. The exemplary embodiments are not intended to be exhaustive of all embodiments according to the present disclosure. It can be understood that without departing from the scope of the present disclosure, other embodiments may be used, and structural or logical modifications may also be made. Therefore, the following detailed description is not restrictive, and the scope of the present disclosure is defined by the appended claims.

A method of reducing wind resistance of an antenna includes changing a cross-sectional shape of a radome (i.e., an antenna covering and protection structure) to make the shape of the radome better meet characteristics of fluid mechanics. In addition to that the radome provides reliable mechanical protection for a base station antenna, a cross-sectional design of the radome also affects electrical performance. For example, the Chinese utility model patent CN208272135U discloses that a cross section of the radome is designed to be a semi-circular arc. Although this design can reduce the wind resistance of the antenna to a certain extent, the resistance reduction effect brought by optimization of the cross-sectional shape of the radome is often limited by internal space layout of the antenna and thereby cannot be implemented well in general.

Although the optimization of wind resistance in a cross-sectional direction of the antenna is often limited, there is indeed a lot of room for optimization of resistance reduction in a longitudinal direction of the antenna. However, such optimization is rarely considered and an optimization solution is rarely proposed. The present disclosure provides an end cover that reduces the wind resistance of the radome, so as to reduce an overall wind resistance of the antenna including the end cover.

In a nutshell, the shape of the disclosed end cover is aerodynamically improved and optimized. After being assembled with the radome, the wind resistance of the base station antenna can be significantly reduced, thereby improving reliability of mounting the antenna on a tower. In addition, while the end cover can reduce the wind resistance of the antenna, length of the antenna does not increase after the end cover is assembled with the radome.

In order to achieve the above technical effects, the end cover according to the present disclosure has a streamlined design. When fluid such as air passes through the streamlined end cover, the fluid can adhere to the surface of the end cover without fluid separation.

In addition to the streamlined design, in some embodiments, certain grooves can be arranged at the end cover, and the arrangement of these grooves can further reduce the wind resistance of the antenna. Moreover, alternatively or additionally, the end cover is convex on radiating surface of the antenna, and the convex shape is no longer purely rounded, but with more deformation. For example, the end cover is front convex and rear retracted on mounting surface, and the design of this shape can make it reasonable to occupy a part of the internal space of the antenna, so that the length of the antenna does not increase.

Furthermore, the end cover according to the present disclosure has simple shape, convenient shape forming, convenient mounting, good structural stability, and easy mass production. Also, the streamlined end cover according to the present disclosure is more variable in shape compared with a full-arc end cover. For example, a ratio of the front convex part and the rear retracted part can be adjusted according to actual application, so that the end cover is also more compatible. There is no need to change the length and cross-sectional shape of the antenna, and space utilization is better. That is, as long as the end cover is in a form of "front convex and rear retraced", it is within the protection scope of the present disclosure.

Hereinafter, the structural features of the end cover according to the present disclosure is described in detail with reference to FIGS. 1 to 8.

FIG. 1 shows a perspective view of an end cover 100 for a radome according to an embodiment of the present disclosure. As can be seen from FIG. 1, the end cover 100 for the radome defines an end cover plane 110 that is perpendicular to a longitudinal axis AA of the radome and passes through a connection part of the end cover 100 and the radome. In some embodiments, the end cover plane 110 can be viewed as a virtual reference plane. The end cover 100 includes a front convex structure 120 and a rear retracted structure 130. In addition, the end cover 100 also includes two side surfaces 140.

Figure 2:
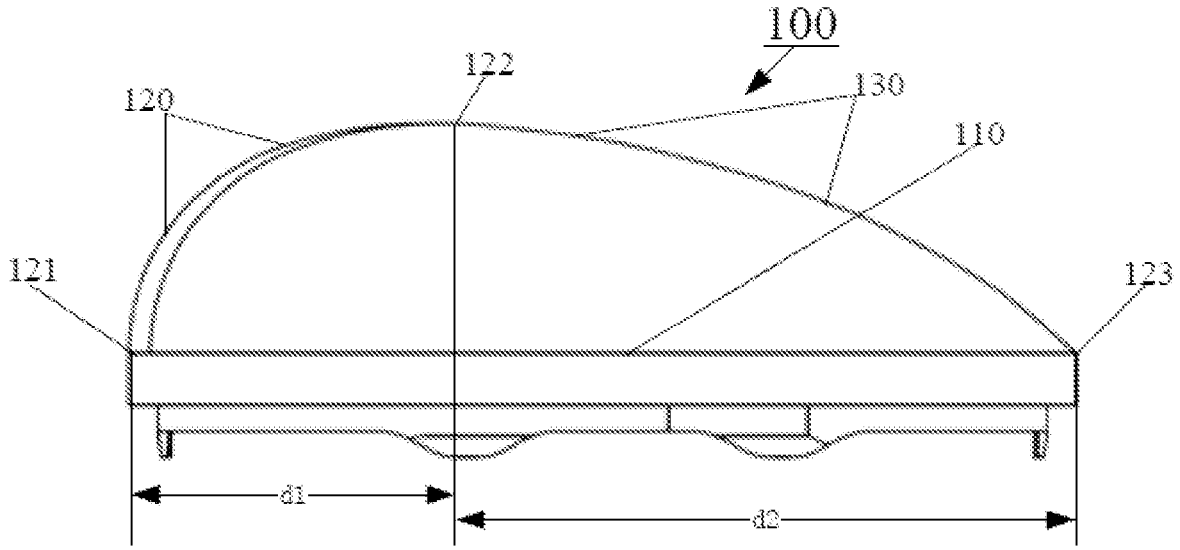
FIG. 2 shows a side view of the end cover 100 for the radome shown in FIG. 1.
Figure 3:
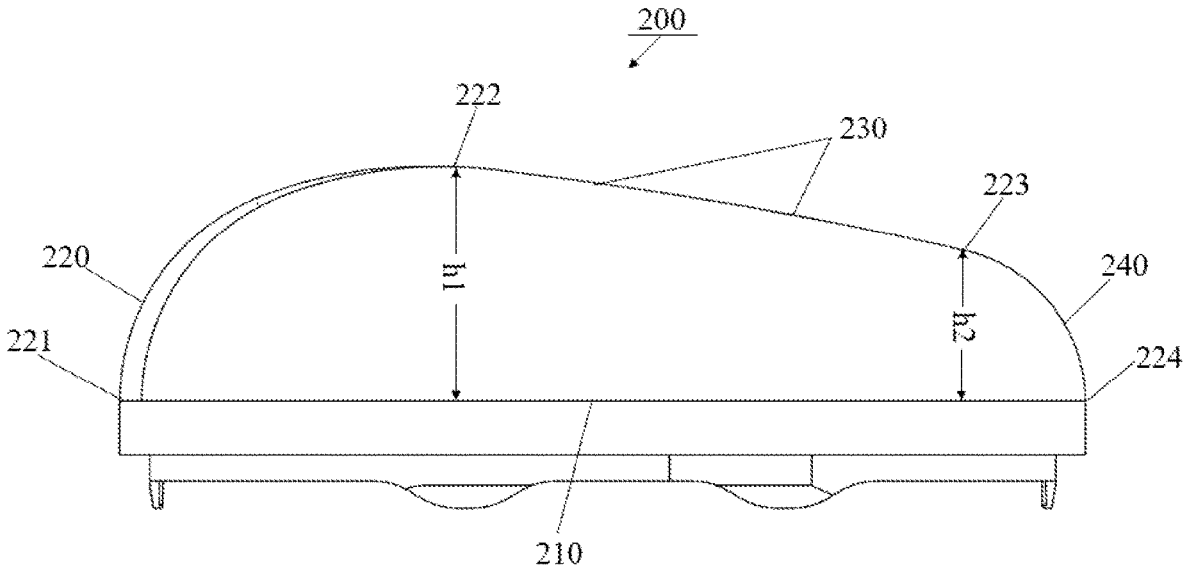
FIG. 3 shows a side view of an end cover 200 for a radome according to another embodiment of the present disclosure.

In order to describe the end cover structure according to the present disclosure in more detail, outlines of the cross section of the end cover perpendicular to direction BB of the end cover in FIG. 1 are described below with reference to FIGS. 2 and 3. FIG. 2 shows a side view of the end cover 100 for the radome shown in FIG. 1. As can be seen from FIGS. 1 and 2, FIG. 2 is a cross section along a direction perpendicular to the direction BB of the end cover 100 in FIG. 1. The outlines of the cross section of the end cover 100 include a first spline curve 120 and a second spline curve 130.

The first spline curve 120 extends between a first end point 121 and a first intermediate point 122 and has at least one first curvature, in this embodiment, where the first end point 121 is located in the end cover plane 110. In some embodiments, the first end point 121 may not be located in the end cover plane 110, for example, it may be located above the end cover plane 110 in the direction perpendicular to direction BB.

The second spline curve 130 extends between a second intermediate point (the second intermediate point and the first intermediate point 122 overlap in the embodiment shown in FIG. 2) and a third intermediate point 123 and has at least one second curvature, where the first intermediate point 122 and the second intermediate point are not located in the end cover plane 110.

The average value of the at least one first curvature is greater than the average value of the at least one second curvature, and the distance between the first intermediate point 122 and the end cover plane 110 and the distance between the second intermediate point and the end cover plane 110 are equal and not less than the distance between any point on the cross section of the end cover 100 and the end cover plane 110. FIG. 2 shows a front convex and rear retracted structure described before, in which a first length d1 of the projection of the first spline curve 120 on the end cover plane 110 is smaller than the second length d2 of the projection of the second spline curve 130 on the end cover plane 110, and the first length d1 is between 0.2 and 1 times the second length d2. In one embodiment, the first length d1 is 0.5 to 0.6 times the second length d2. In this manner, aerodynamic performance of the end cover 100 can be further optimized, and wind resistance characteristics of the end cover 100 can be further reduced.

Those skilled in the art should understand that in the example shown in FIG. 2, the first intermediate point 122 and the second intermediate point overlap, and in some other embodiments, the first intermediate point 122 and the second intermediate point may not overlap, which means that in a case when the end cover 100 is mounted in the direction shown in FIG. 2, the top of the end cover has a horizontal surface.

In addition, as can be seen from FIG. 2, the third intermediate point 123 is located in the end cover plane 110. In some embodiments, the third intermediate point 123 may not be located in the end cover plane 110, for example, it may be located above the end cover plane 110 in the direction shown in FIG. 2.

Furthermore, those skilled in the art should understand that in the direction shown in FIG. 2, the connection part of the end cover 100 and the radome is a horizontal plane, which is only an example. Besides this, the connection part of the end cover 100 and the radome can also be, for example, an inclined plane, or even not a plane. But no matter what shape the end cover 100 of the antenna is, it always has an end cover plane 110 that is perpendicular to the longitudinal axis AA of the radome and passes through the connection part of the end cover 100 and the radome. For example, when the end of the radome is a tangentially chamfered plane instead of a horizontal plane, the end cover plane 110, for example, can pass through a higher position of the connection part of the end cover 100 and the radome. That is, the end cover plane 110 is used as a virtual reference interface.

Thus, the end cover according to the present disclosure can be aerodynamically optimized and designed. When the end cover and the radome are assembled, the wind resistance of the entire antenna including the end cover, the radome, and the base station antenna contained in the radome can be significantly reduced, and thereby the reliability of mounting the antenna on the tower is improved. In addition, while the end cover can reduce the wind resistance of the antenna, the length of the base station antenna does not increase after the end cover is assembled with the radome.

Here, those skilled in the art should understand that the spline curve may not only have one curvature. For example, one spline curve may have multiple curvatures. For example, the first spline curve 120 may have multiple first curvatures. Similarly, the second spline curve 130 may have multiple second curvatures. In the technical solution of the present disclosure, it is required that the average value of the at least one first curvature is greater than the average value of the at least one second curvature. In some embodiments, the smallest first curvature among the multiple first curvatures is greater than the largest second curvature among the multiple second curvatures. That is, the first curvature corresponding to the part with the smallest curvature in the first spline curve 120 is also greater than the second curvature corresponding to the part with the largest curvature in the second spline curve 130.

In some embodiments, the end cover may also include other parts. For example, FIG. 3 shows a side view of an end cover 200 for the radome according to another embodiment of the present disclosure. As can be seen from FIG. 3, an end cover 200 for the radome according to the present disclosure defines an end cover plane 210 that is perpendicular to the longitudinal axis of the radome and passes through the connection part of the end cover 200 and the radome. The outlines of the cross section of the end cover 200 include a first spline curve 220 and a second spline curve 230. The first spline curve 220 extends between a first end point 221 and a first intermediate point 222 and has at least one first curvature, where the first end point 221 is located in the end cover plane 210. The second spline curve 230 extends between a second intermediate point (which overlaps with the first intermediate point 222 in the embodiment shown in FIG. 3) and a third intermediate point 223 and has at least one second curvature, where the first intermediate point 222 and the second intermediate point (which overlaps with the first intermediate point 222 in the embodiment shown in FIG. 3) are not located in the end cover plane 210. The distance between the first intermediate point 222 and the end cover plane 210 and the distance between the second intermediate point and the end cover plane 210 are equal and not less than the distance between any point on the cross section of the end cover 200 and the end cover plane 210, and the average value of the at least one first curvature is greater than the average value of the at least one second curvature. For example, as can be seen from FIG. 3, a third distance h2 between the third intermediate point 223 and the end cover plane 210 is within 90% of a first distance h1 between the first intermediate point 222 and the end cover plane 210. In some embodiments, the third distance h2 between the third intermediate point 223 and the end cover plane 210 is 60%~70% of the first distance h1 between the first intermediate point 222 and the end cover plane 210. In terms of specific dimensions, for example, the first distance h1 here may be higher than 10 mm. Those skilled in the art should understand that in the example shown in FIG. 3, the first intermediate point 222 and the second intermediate point overlap, and in some other embodiments, the first intermediate point 222 and the second intermediate point may not overlap, which means that in a case when the end cover 200 is mounted in the direction shown in FIG. 3, the top of the end cover has a horizontal surface.

In addition to the two spline curves described above, in the example shown in FIG. 3, the end cover 200 also includes a third spline curve 240, and the third spline curve 240 extends between the third intermediate point 223 and a second end point 224 and has at least one third curvature, where the third intermediate point 223 is not located in the end cover plane 210 and the second end point 224 is located in the end cover plane 210. The average value of the at least one third curvature is greater than the average value of the at least one first curvature and the average value of the at least one second curvature. In this manner, the spline curves of the end cover 200 according to the present disclosure include not only the first spline curve 220 and the second spline curve 230, but also the third spline curve 240. With the third spline curve 240, the aerodynamic performance of the end cover 200 can be further optimized, and the wind resistance characteristics of the end cover 200 can be further reduced.

Here, those skilled in the art should understand that the spline curve may not only have one curvature. For example, one spline curve may have multiple curvatures. For example, the first spline curve 220 may have multiple first curvatures. Similarly, the second spline curve 230 may have multiple second curvatures. In the technical solution of the present disclosure, it is required that the average value of the at least one first curvature is greater than the average value of the at least one second curvature. In some embodiments, the smallest first curvature among the multiple first curvatures is greater than the largest second curvature among the multiple second curvatures. That is, the first curvature corresponding to the part with the smallest curvature in the first spline curve 220 is also greater than the second curvature corresponding to the part with the largest curvature in the second spline curve 230. In addition, similarly, for example, the third spline curve 240 may have multiple third curvatures. In some embodiments, the smallest third curvature among the multiple third curvatures is greater than the largest first curvature among the multiple first curvatures and the largest second curvature among the multiple second curvatures. That is, the third curvature corresponding to the part with the smallest curvature in the third spline curve 240 is also greater than the first curvature corresponding to the part with the largest curvature in the first spline curve 220 and the second curvature corresponding to the part with the largest curvature in the second spline curve 230. In addition, the cross section of the end cover is smooth at the first intermediate point and the second intermediate point. The first curve 220 included in the outlines of the cross section of the end cover, the part between the first intermediate point 222 and the second intermediate point (which overlaps with the first intermediate point 222 in the example shown in FIG. 3), and the second spline curve 230 together form a spline.

In addition to the spline curves described above, the end cover according to the present disclosure may also include other parts. For example, on an outer surface of the end cover 200, besides the spline curves 220, 230, and 240, it may also include at least two side outline surfaces (not shown in the figure). The at least two side outline surfaces and the top outline surface including the first spline curve 220, the second spline curve 230, and possibly the third spline curve 240 together form the end cover 200.

In an embodiment according to the present disclosure, the end covers 100 and 200 can be, for example, made of a glass fiber composite material. In this way, the structural strength of the end covers 100 and 200 according to the present disclosure can be enhanced, and the structural stability thereof can be optimized, so that they are not easily deformed or only have a small deformation when subjected to wind, which thereby provides a strong guarantee to optimize the aerodynamic performance and reduce the wind resistance of the end covers 100 and 200. In an embodiment according to the present disclosure, the end covers 100 and 200 are manufactured by a compression molding process. In this manner, the end covers can be mass produced in a simple process, thereby reducing the manufacturing cost of the end covers 100 and 200. That is, the material of the end cover of the present disclosure may be, for example, a glass fiber reinforced plastic material, which is formed by compression molding, and the strength of the manufactured end cover is higher than that of ordinary plastic molding. A high-rigidity end cover increases restraining rigidity of the end of the radome, increase modal frequency of the antenna, and reduce deformation of the antenna when subjected to wind, which thereby also improves the overall wind resistance of the antenna. In some embodiments, other materials and molding processes can also be used.

In the present disclosure, the first spline curve, the second spline curve and/or the third spline curve may be in form of a small radius arc, a straight line, or a spline curve with an indefinite pattern, and the second spline curve may even be a structure similar to the straight line.

In addition to the spline feature described above, in order to further optimize the wind resistance characteristics of the end cover described above, the end cover can also be designed with other features. Other design points in addition to the spline feature are introduced below in conjunction with FIGS. 4-8. For example, some surface drag reduction features, such as structures like pits, convex hulls, grooves and/or protrusion strips, can be added to the end cover of the present disclosure.

Figure 4:
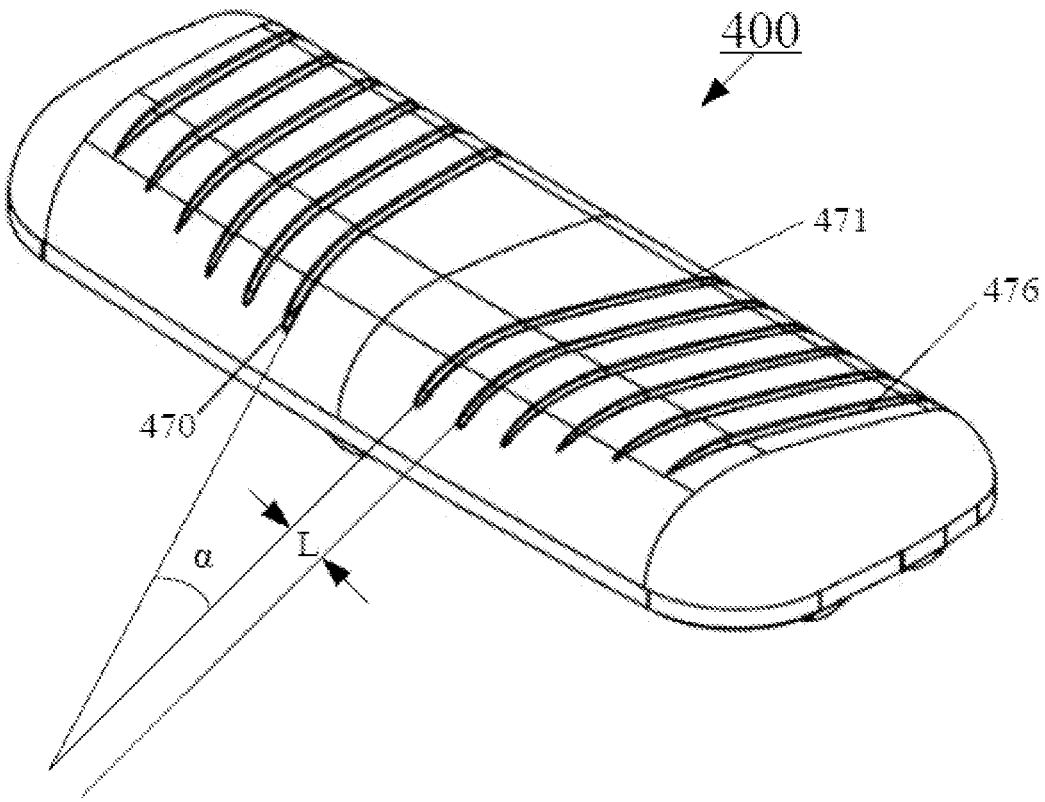
FIG. 4. shows a perspective view of an end cover 400 for a radome according to another embodiment of the present disclosure.

FIG. 4 shows a perspective view of an end cover 400 for the radome according to another embodiment of the present disclosure. As can be seen from FIG. 4, in the embodiment shown in FIG. 4, multiple grooves 470 are provided on an outer surface of the end cover 400, and each of the grooves 470 can have, for example, a circular arc, an inverted trapezoid, a rectangular, and/or a V-shaped cross-sectional shape. As shown in FIG. 4, in the present disclosure, some drag reduction grooves 470 are arranged on the surface of the end cover 400, and the shape of the grooves 470 may be a circle, an inverted trapezoid, a rectangle, a V-shape, etc. The grooves in FIG. 4 of the present disclosure are, for example, semicircular grooves. The drag reduction grooves are distributed in a "eight-shaped" shape. The angle $\alpha$ between the grooves on two sides is, for example, 20°, and the distance L between the grooves on the same side is, for example, 30 mm. The addition of these grooves 470 can reduce burstiness of turbulence and increase sequence of flow when fluid flows through the surface of the end cover 400, and thereby reduce turbulent kinetic energy of the flow. Studies have shown that the wind resistance of the end cover with the drag reduction grooves 470 is about 2% lower than that of the end cover without the drag reduction grooves 470. In addition, the addition of these grooves 470 also increases deformation resistance of the end cover, thereby enhancing the deformation resistance of the radome that cooperates with the end cover 400. In addition, as can be seen from FIG. 4, these grooves 470 are not of equal length, and the closer to longitudinal end edge, the shorter of the length. For example, as can be seen from FIG. 4, the length of these grooves is getting shorter and shorter along the direction from groove 471 to groove 476. However, those skilled in the art should understand that such an example is only exemplary and not restrictive, and other arrangements such as setting the grooves to be of equal length are also feasible.

Figure 5:
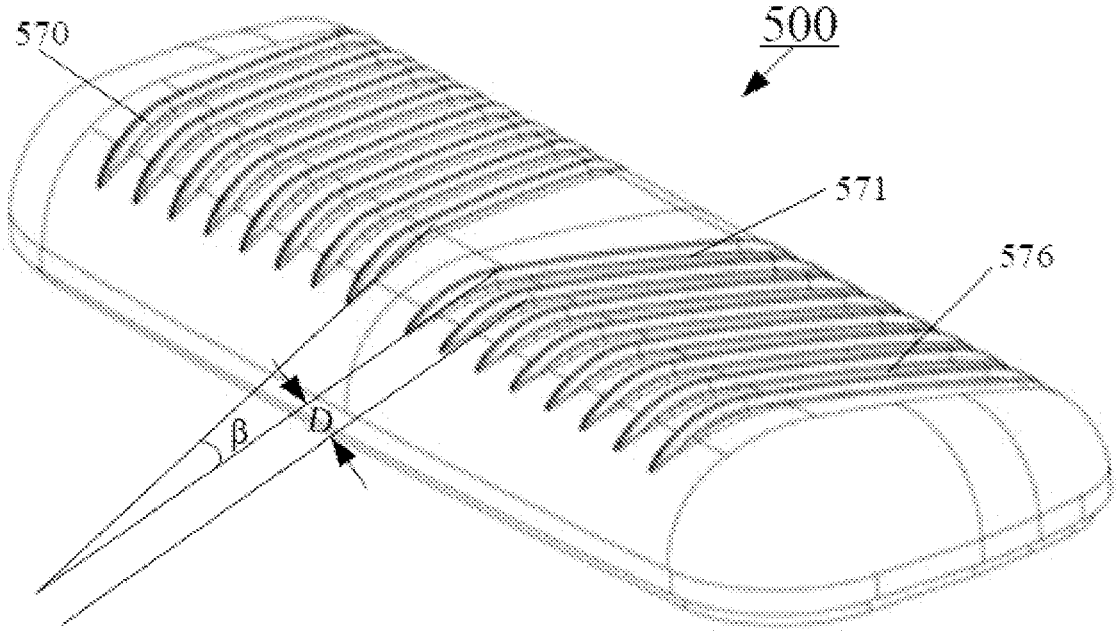
FIG. 5. shows a perspective view of an end cover 500 for a radome according to another embodiment of the present disclosure.

In some embodiments, these drag reduction grooves may not be grooves formed lower than an upper surface of the end cover, but may also be, for example, grooves formed by protrusions higher than the upper surface of the end cover, as shown in the FIG. 5. FIG. 5 shows a perspective view of an end cover 500 for the radome according to another embodiment of the present disclosure. As can be seen from FIG. 5, in the embodiment shown in FIG. 5, multiple protrusion strips 570 are provided on the outer surface of the end cover 500, and each of the protrusion strips 570 can have, for example, a circular arc, a trapezoidal, a rectangular, and/or an inverted V-shaped cross-sectional shape. The present disclosure employs, for example, semicircular protrusion strips 570. The drag reduction protrusion strips are distributed in a "eight-shaped" shape. The angle $\beta$ between the protrusion strips on two sides is, for example, 10°, and the distance D between the protrusion strips on the same side is, for example, 20 mm. The addition of these protrusion strips 570 can reduce burstiness of turbulence and increase sequence of flow when fluid flows through the surface of the end cover 500, and thereby reduce turbulent kinetic energy of the flow. Studies have shown that the wind resistance of the end cover with the drag reduction protrusion strips 570 is about 3% lower than that of the end cover without the drag reduction protrusion strips 570. In addition, the addition of these protrusion strips 570 also increases deformation resistance of the end cover, thereby enhancing the deformation resistance of the radome that cooperates with the end cover 500. In addition, as can be seen from FIG. 5, these protrusion strips 570 are all of equal length, that is, protrusion strip 571 and protruding strip 576 can be of equal length. However, those skilled in the art should understand that such an example is only exemplary and not restrictive, and other arrangements such as setting each protruding strip 570 to be shorter as they are closer to the longitudinal end edge are also feasible.

In summary, in the embodiments shown in FIGS. 4 and 5, the multiple grooves are divided into a first groove group (for example, the grooves on the left side in FIG. 4 or the left grooves formed by the protrusion strips in FIG. 5) and a second groove group (for example, the groove on the right side in FIG. 4 or the right grooves formed by the protrusion strips in FIG. 5). The grooves in the first groove group are parallel to each other, and the distance between the first grooves may be, for example, within 50 mm. The grooves in the second groove group are parallel to each other, and the distance between the second grooves may also be, for example, 50 mm. The depth of the first grooves and the second grooves can be, for example, within 5 mm. The distance between the first groove closest to the second groove group in the first groove group and the second groove closest to the first groove group in the second groove group at a larger distance can be, for example, greater than 80 mm. The grooves in the first groove group and the grooves in the second groove group are not parallel and have a first included angle (for example, the included angle $\alpha$ in FIG. 4 and the included angle $\beta$ in FIG. 5). The first included angle is in a range of 10 degrees to 60 degrees, and in some embodiments, the first included angle is in a range of 20 degrees to 40 degrees.

Figure 6:
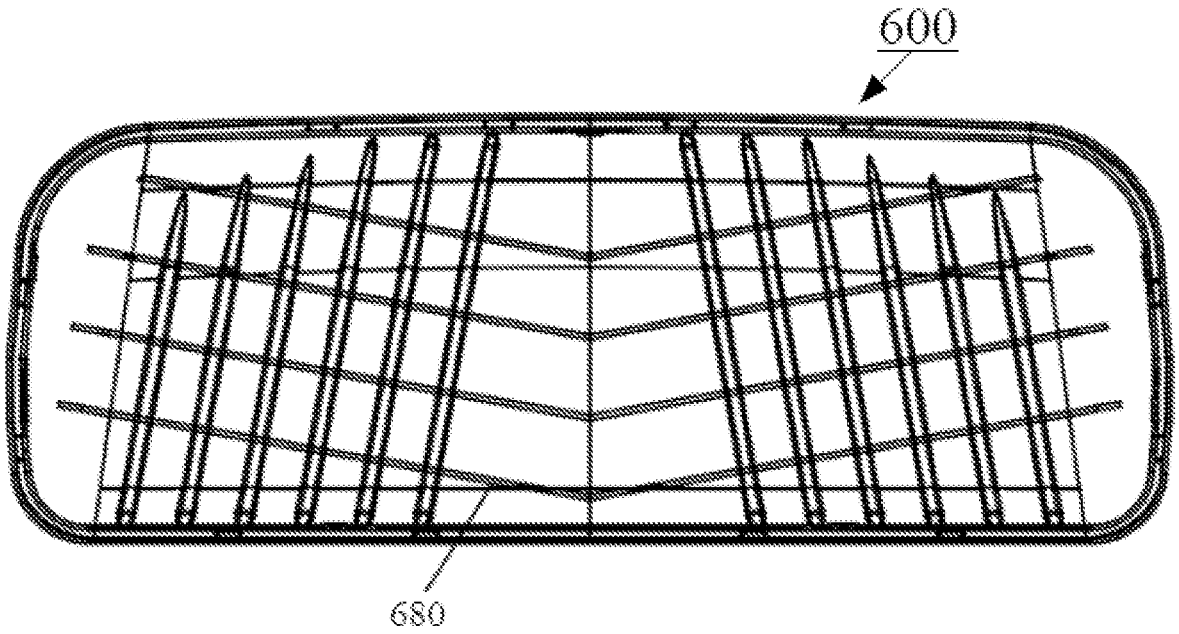
FIG. 6. shows a bottom view of an end cover 600 for a radome according to another embodiment of the present disclosure.

Based on FIGS. 4 and 5, inventors of the present disclosure have thought of further increasing the structural strength of the end cover according to the present disclosure. Thus, they have thought of adding a certain number of diagonal ribs on an inner surface of the end cover, which can make the entire end cover have good mechanical properties and enhance the structural strength. FIG. 6 shows a bottom view of an end cover 600 for the radome according to another embodiment of the present disclosure. As can be seen from FIG. 6, the inner surface of the end cover 600 is provided with diagonal ribs 680. The extending direction of the diagonal ribs 680 is different from the extending direction of the grooves or protrusion strips on the other surface.

Figure 7:
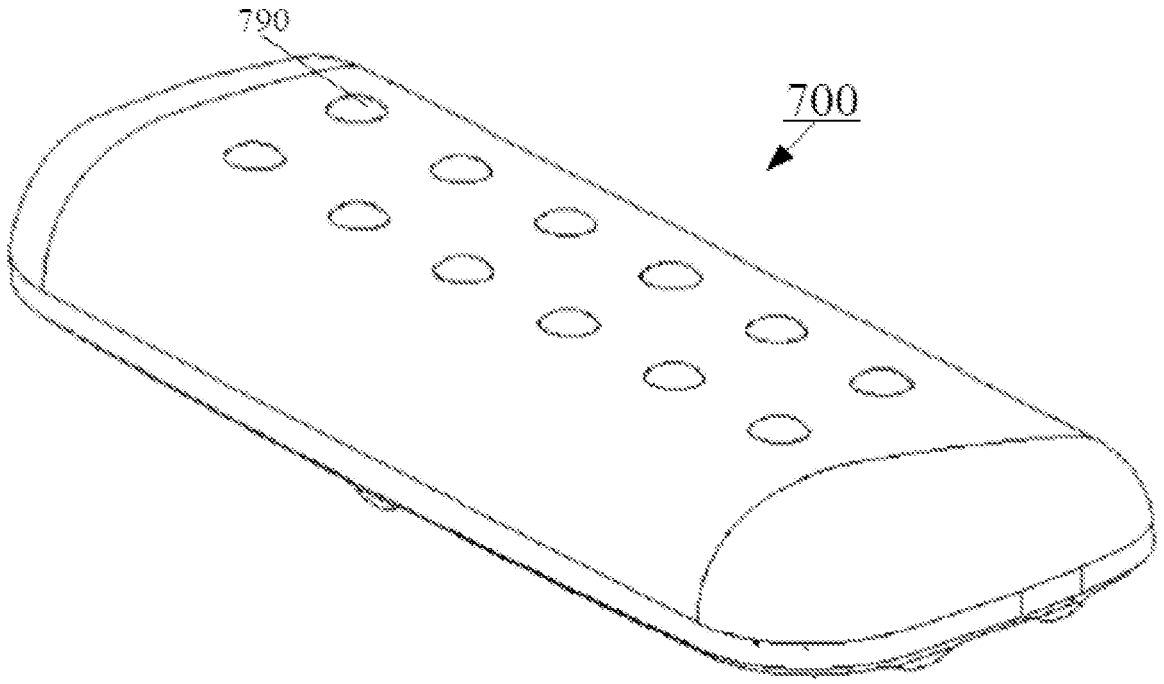
FIG. 7 shows a perspective view of an end cover 700 for a radome according to another embodiment of the present disclosure.
Figure 8:
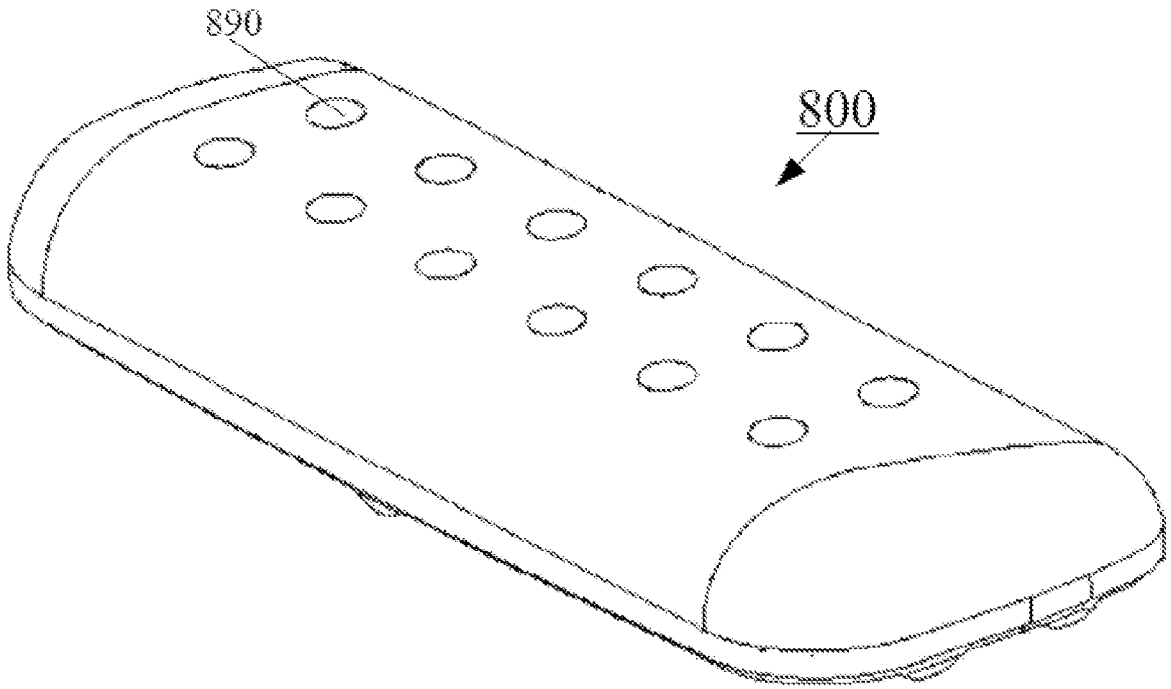
FIG. 8 shows a perspective view of an end cover 800 for a radome according to another embodiment of the present disclosure.

In addition to the drag reduction features of the grooves and protrusion strips described above, other drag reduction features, such as protrusions or recesses, can also be designed. FIG. 7 shows a perspective view of an end cover 700 for the radome according to another embodiment of the present disclosure. As can be seen from FIG. 7, in addition to the common features described above, the spline curves on the outer surface of the end cover 700 are evenly distributed with convex hulls 790. In one embodiment, the diameter of the convex hull is, for example, within 5 cm, the height is, for example, within 1 cm, and the distance between the convex hulls is, for example, within 10 cm. FIG. 8 shows a perspective view of an end cover 800 for the radome according to another embodiment of the present disclosure. As can be seen from FIG. 8, in addition to the common features described above, the spline curves on the outer surface of the end cover 800 are evenly distributed with pits 890. In one embodiment, the diameter of the pit is, for example, within 5 cm, the depth is, for example, within 1 cm, and the distance between the pits is, for example, within 10 cm. Those skilled in the art should understand that the distribution of the convex hulls in FIG. 7 and the distribution of the pits in FIG. 8 are only exemplary and not restrictive. In some embodiments, these pits or convex hulls can cover the entire surface of the end cover.

Figure 9:
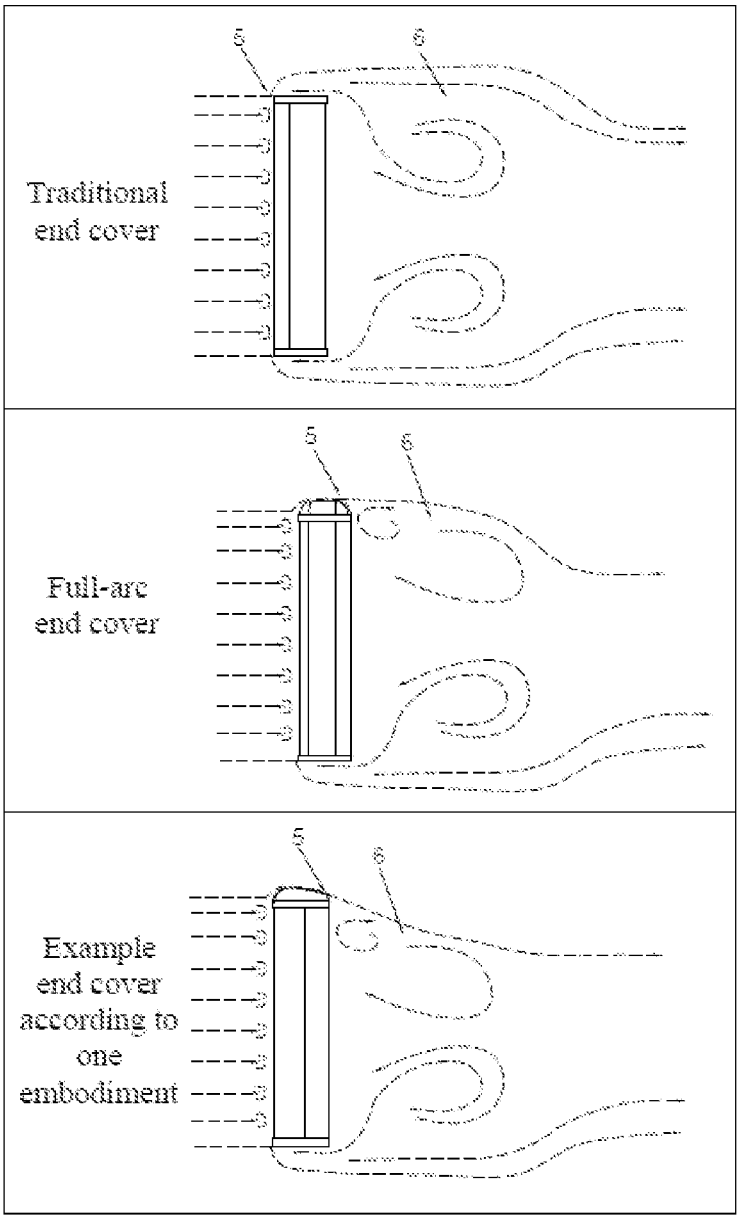
FIG. 9 shows a schematic diagram 900 of an air flow performance of an end cover according to an embodiment of the present disclosure compared with air flow performance of a traditional end cover.

In order to clearly describe the technical effect of the end cover according to the present disclosure, FIG. 9 shows a schematic diagram 900 of an air flow performance of the end cover according to the present disclosure compared with a traditional end cover. In a nutshell, for a bluff body structure such as the base station antenna, differential pressure resistance is an dominant resistance. Since the actual air fluid is viscous, the separation of the fluid can cause pressure distribution on surfaces of an object to be asymmetry, thereby forming the differential pressure resistance.

Compared with the traditional end cover shown in an upper part of FIG. 9, a separation point 5 in the longitudinal direction of the antenna can be delayed to the rear of the end cover according to an end cover shown in a middle part of FIG. 9. But the full-arc end cover is not a perfect drag reduction solution. After the fluid passes through a front arc, it extends straight back and separates, and there is no process of attaching the end cover downward. As shown in a lower part of FIG. 9, the end cover according to the present disclosure has a "front convex and rear retracted" effect in its form, and the "rear retracting" of the end cover is relatively gentle, so that the fluid can have a downward pressure trend after passing through the end cover, and can be attached to the end cover as much as possible. Therefore, a negative pressure zone 6 at the rear of the radome is lower, so that the purpose of further drag reduction can be achieved.

In other words, as can be seen from FIG. 9, the drag reduction end cover according to the present disclosure (the end cover example in bottom of FIG. 9) is compared with a common flat end cover (the end cover example in top of in FIG. 9). The streamlined structure of the present disclosure allows the fluid to be well attached to the surface of the end cover, so that the separation point 5 in the longitudinal direction of the antenna can be delayed to the rear of the end cover, and the push of the separation point 5 can reduce the negative pressure zone 6 at the rear of the radome, so that the purpose of drag reduction can be achieved.

Figure 10:
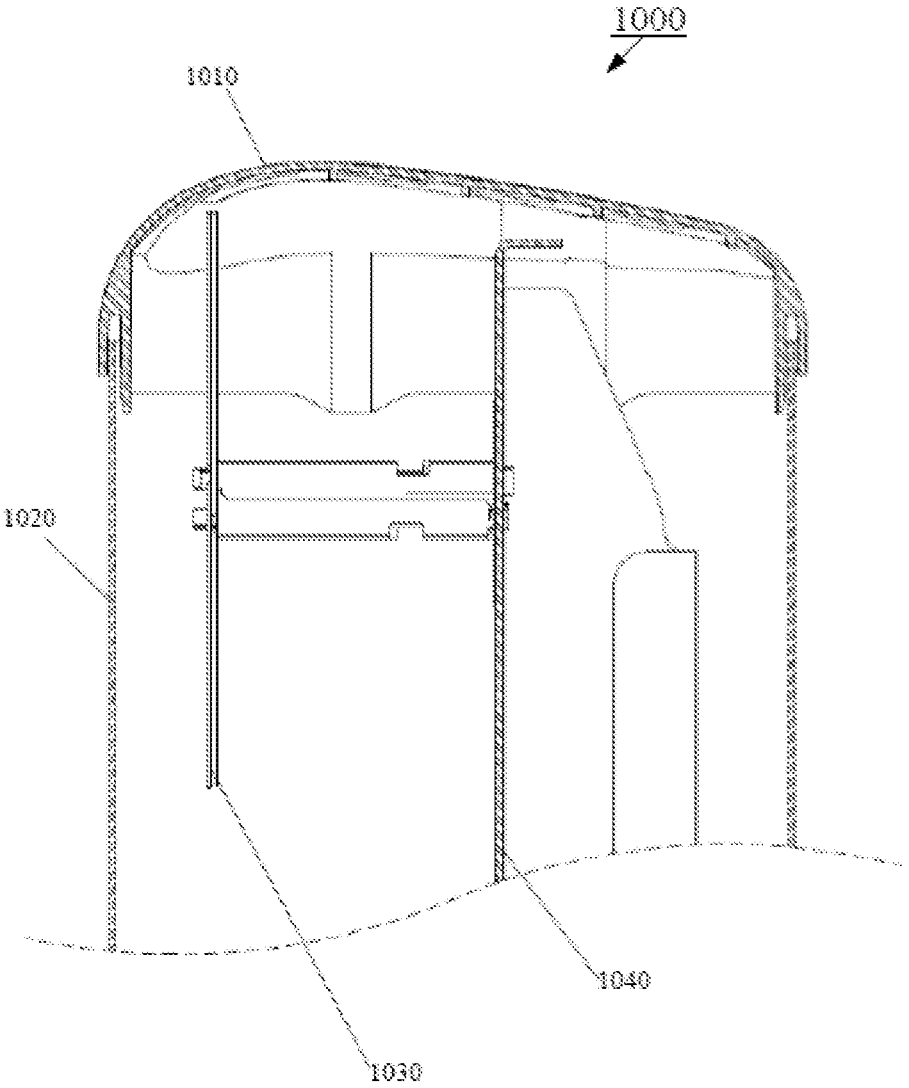
FIG. 10 shows a schematic diagram of a radome assembly 1000 according to an embodiment of the present disclosure.

FIG. 10 shows a schematic diagram of a radome assembly 1000 according to the present disclosure. As can be seen from FIG. 10, the radome assembly 1000 includes a radome 1020. A main body of the radome 1020 defines a first accommodation cavity for accommodating an antenna including a radiating element 1030 and a reflector 1040. The radome assembly 1000 also includes an end cover 1010 consistent with the present disclosure as described above, and the end cover 1010 can be mounted at the end of the radome 1020. In the example of FIG. 10, the end cover 1010 is mounted at an upper end of the radome 1020. Those skilled in the art should understand that other mounting directions are also possible. For example, the end cover 1010 can be mounted at a lower end of the radome 1020. In some embodiments, it is also feasible that the end cover 1010 can be mounted at a left end or a right end of the radome 1020. In some embodiments, the projection of a radiation arm of the radiating element 1030 on the end cover plane of the end cover 1010 is within the projection of a curved surface where the first spline curve of the end cover 1010 is located on the end cover plane. The end cover 1010 has a second accommodation cavity communicating with the first accommodation cavity, and the radiation arm is at least partially located in the second accommodation cavity. This arrangement is to make full use of the inner space of a convex structure of the end cover 1010 in the main radiation direction, that is, the space surrounded by the curved surface where the first spline curve is located, thereby reducing the length of the radome assembly 1000 in the direction AA (referring to FIG. 1).

Generally speaking, the antenna including the end cover of the present disclosure is convex on the radiation surface of the antenna, and the convex shape is no longer purely rounded. For example, by adjusting the ratio of the front convex part and the rear retracted part, the shape of the end cover is more variable, so it has good spatial compatibility, and the length of the antenna does not increase. Since the front part of the end cover protrudes outwards, antenna radiating elements can be at least partially contained in the end cover, so that the inner space of the end cover can be reasonably used and the length of the radome assembly can be reduced.

In summary, the shape of the end cover according to the present disclosure can be aerodynamically optimized. When the end cover is assembled with the radome, the wind resistance of the entire antenna including the end cover, the radome, and the base station antenna contained in the radome can be significantly reduced, thereby improving the reliability of mounting the antenna on the tower. In addition, while the end cover can reduce the wind resistance of the antenna, the length of the base station antenna does not increase after the end cover is assembled with the radome.

Although different exemplary embodiments of the present disclosure have been described, it is obvious to those skilled in the art that various changes and modifications can be made, which can realize one or some of the advantages of the present disclosure without departing from the spirit and scope of the present disclosure. For those skilled in the art, other components performing the same function can be replaced as appropriate. It should be understood that the features explained herein with reference to a particular figure can be combined with features of other figures, even in those cases where this is not explicitly mentioned. In addition, the method of the present disclosure can be implemented either in all software implementations using appropriate processor instructions or in a hybrid implementation using a combination of hardware logic and software logic to achieve the same result. Such modifications to the solution according to the present disclosure are intended to be covered by the appended claims.

What is claimed is:

1. An end cover comprising:

an end cover plane perpendicular to a longitudinal axis of a radome and passing through a connection part of the end cover and the radome;

wherein:

outlines of a cross section of the end cover comprises:

a first spline curve between a first end point and a first intermediate point and having at least one first curvature; and a second spline curve between a second intermediate point and a third intermediate point and having at least one second curvature, the first intermediate point and the second intermediate point being not located in the end cover plane;

a distance between the first intermediate point and the end cover plane and a distance between the second intermediate point and the end cover plane are equal and not less than a distance between any point on the cross section of the end cover and the end cover plane, and an average value of the at least one first curvature is greater than an average value of the at least one second curvature; and an outer surface of the end cover is provided with a first drag reduction feature group located at one side of the outer surface, and a second drag reduction feature group located at the other side of the outer surface, each drag reduction feature group including a plurality of parallel grooves or protrusion strips along a generally lateral direction of the end cover.

2. The end cover of claim 1, wherein the first intermediate point and the second intermediate point overlap.

3. The end cover of claim 1, wherein the third intermediate point is located in the end cover plane.

4. The end cover of claim 1, wherein the cross section of the end cover further comprises:

a third spline curve extending between the third intermediate point and a second end point and having at least one third curvature, the third intermediate point being not located in the end cover plane and the second end point being located in the end cover plane, and the average value of the at least one third curvature being greater than the average value of the at least one first curvature and the average value of the at least one second curvature.

5. The end cover of claim 4, wherein a third distance between the third intermediate point and the end cover plane is within 90% of a first distance between the first intermediate point and the end cover plane.

6. The end cover of claim 5, wherein the third distance between the third intermediate point and the end cover plane is 60%~70% of the first distance between the first intermediate point and the end cover plane.

7. The end cover of claim 1, wherein the cross section of the end cover is smooth at the first intermediate point and the second intermediate point.

8. The end cover of claim 1, further comprising at least two side outline surfaces, wherein the at least two side outline surfaces and a top outline surface together form the end cover, the top outline surface comprising the first spline curve and the second spline curve.

9. The end cover of claim 1, wherein a first length of a projection of the first spline curve on the end cover plane is smaller than a second length of a projection of the second spline curve on the end cover plane.

10. The end cover of claim 1, wherein a first length is between 0.2 and 1 times a second length d2.

11. The end cover of claim 10, wherein the first length is between 0.5 to 0.6 times the second length d2.

12. The end cover of claim 1, wherein the end cover is made of a glass fiber composite material.

13. The end cover of claim 1, wherein the first spline curve, a part between the first intermediate point and the second intermediate point, and the second spline curve together form a spline.

14. The end cover of claim 1, wherein a cross-sectional shape of each of the grooves or protrusion strips is a circular arc, an inverted trapezoid, a rectangular, or a V-shaped.

15. The end cover of claim 1, wherein the first end point is located in the end cover plane.

16. The end cover of claim 1, wherein an inner surface of the end cover is provided with diagonal ribs.

17. The end cover of claim 1, wherein the grooves or protrusion strips in the first groove group and the grooves or protrusion strips in the second groove group are not parallel and have a first acute angle.

18. The end cover of claim 17, wherein:

the first acute angle is in a range of 20 degrees to 40 degrees.

19. A radome assembly comprising:

a radome having a first accommodation cavity configured to accommodate a plurality of radiating elements; and an end cover comprising:

an end cover plane perpendicular to a longitudinal axis of the radome and passing through a connection part of the end cover and the radome;

wherein:

outlines of a cross section of the end cover comprises:

a first spline curve between a first end point and a first intermediate point and having at least one first curvature; and a second spline curve between a second intermediate point and a third intermediate point and having at least one second curvature, the first intermediate point and the second intermediate point being not located in the end cover plane;

a distance between the first intermediate point and the end cover plane and a distance between the second intermediate point and the end cover plane are equal and not less than a distance between any point on the cross section of the end cover and the end cover plane, and an average value of the at least one first curvature is greater than an average value of the at least one second curvature; and an outer surface of the end cover is provided with a first drag reduction feature group located at one side of the outer surface, and a second drag reduction feature group located at the other side of the outer surface, each drag reduction feature group including a plurality of parallel grooves or protrusion strips along a generally lateral direction of the end cover;

wherein:

the end cover is mounted at an end of the radome; and the first spline curve of the end cover is located on a curved surface, a projection of a radiation arm of the radiating element on the end cover plane of the end cover is within a projection of the curved surface on the end cover plane.

20. The radome assembly of claim 19, wherein the end cover has a second accommodation cavity communicating with the first accommodation cavity, at least part of the radiation arm is located in the second accommodation cavity.

* * * * *